United States Patent [19]

Counihan

[11] 4,170,859

[45] Oct. 16, 1979

[54] COMPOSITE STRUCTURE AND ASSEMBLY JOINT FOR A FLOOR SYSTEM

[76] Inventor: James Counihan, 2 Williams Dr., Greenville, S.C. 29605

[21] Appl. No.: 842,176

[22] Filed: Oct. 14, 1977

[51] Int. Cl.[2] ..... E04B 5/52; E06B 3/54

[52] U.S. Cl. ..... 52/763; 52/391; 52/392; 52/479; 52/586; 52/592; 52/779

[58] Field of Search ..... 52/479, 464, 489, 512, 52/492, 593, 586, 595, 592, 391, 496, 392, 471, 494, 495, 497

[56] References Cited

U.S. PATENT DOCUMENTS

| | | | |
|---|---|---|---|
| Re. 26,239 | 7/1967 | Rockabrand et al. | 52/480 X |
| 1,714,738 | 5/1929 | Smith | 52/512 |
| 1,974,259 | 9/1934 | Cherry | 52/489 X |
| 2,038,433 | 4/1936 | Lawrence, Jr. | 52/512 |
| 2,088,625 | 8/1937 | Wallace | 52/496 X |
| 2,115,238 | 4/1938 | Stevens | 52/480 X |
| 2,158,732 | 5/1939 | Shannon | 52/471 X |
| 2,316,671 | 4/1943 | Crooks | 52/479 |
| 2,362,252 | 11/1944 | Ellinwood | 52/512 X |
| 2,865,058 | 12/1958 | Andersson et al. | 52/508 |
| 3,016,998 | 1/1962 | Buchmeier | 52/479 |
| 3,248,257 | 4/1966 | Cadotte et al. | 52/492 X |
| 3,267,630 | 8/1966 | Omholt | 52/480 X |
| 3,405,493 | 10/1968 | Omholt | 52/480 |
| 3,492,935 | 2/1970 | Thomas | 52/496 X |
| 3,518,800 | 7/1970 | Tank | 52/480 |
| 3,579,941 | 5/1971 | Tibbals | 52/593 X |
| 3,713,264 | 1/1973 | Morgan, Jr. | 52/489 |

FOREIGN PATENT DOCUMENTS

| | | | |
|---|---|---|---|
| 2553109 | 11/1976 | Fed. Rep. of Germany | 52/489 |
| 2559312 | 7/1977 | Fed. Rep. of Germany | 52/496 |

OTHER PUBLICATIONS

Connor Forest Industries, "Connor 'Laytite'" 1976–1977.

Concrete, Jan. 1950, p. 25, "Joistile".

*Primary Examiner*—Leslie Braun

*Attorney, Agent, or Firm*—Bailey, Dority & Flint

[57] ABSTRACT

A composite structure and an assembly joint for a floor system and the like is disclosed of the type having a plurality of elongated boards arranged generally in a side-by-side and end-to-end abutting configuration wherein an assembly joint is provided for joining the ends of the boards together while the individual boards are joined in a plurality of side-by-side, integral pre-assembled sections. The ends of each board include a groove which defines a unique upper and lower end portion construction which operates with an elongated channel strip to provide a highly improved joint.

8 Claims, 3 Drawing Figures

COMPOSITE STRUCTURE AND ASSEMBLY JOINT FOR A FLOOR SYSTEM

BACKGROUND OF THE INVENTION

The invention relates to systems for constructing floors commonly referred to as strip floor systems wherein either random or regular lengths of wood boards are fitted together. Maple wood boards are popularly used in such constructions which are typically provided with tongue and groove side portions for interlocking with adjacent boards in a side-by-side arrangement. However, the ends of the boards are normally abutted against the other without means of joinder therebetween. One attempt to create a joint between the ends of the boards has been the utilization of a steel spline in one end of the boards which mate with a groove on the opposite end of an abutting board.

Various arrangements of tongue and groove joints are disclosed in U.S. Pat. Nos. 2,038,433 and 3,713,264 which utilize clips spaced at different points along the lengths of the tongue and grooving for securing the boards to the floor. However, the ends are engaged in free abutment.

U.S. Pat. No. 2,865,058 discloses a composite floor system which utilizes elongated strips which run transverse to the length of the boards for clipping a tongue and groove arrangement to the subfloor.

It is noted that most of the prior art floor systems utilize elongated strips of wood with the joints generally formed in the sides thereof. Since buckling normally occurs longitudinally in flooring boards rather than laterally, there is little or no resistence to buckling provided by the securing joints. While the use of a steel spline and groove arrangement at the end of the boards might tend to resist buckling in the longitudinal direction, the joint provided at the end is not secured to the floor and thus buckling of a board may cause the abutting of an adjacent board to also rise up.

SUMMARY OF THE INVENTION

It has been found that a composite structure and joint assembly for use in a wall or flooring system can be provided by a plurality of boards arranged generally in a side-by-side and end-to-end abutment configuration with an assembly joint provided at the abutting ends thereof for joining the boards and securing the boards to the floor. The individual flooring boards include a first end and a second end spaced from the first end with a pair of integral sides extending between the first and second ends. A top wear surface and a spaced bottom surface are integral with the sides and ends. The first end of each board includes a groove formed therein defining an upper end portion and a lower end portion which terminates longitudinally short of the upper end portion. The second end of each board includes a groove formed therein defining an upper end portion and a lower end portion which extends longitudinally past the upper end portion. An elongated mounting strip is provided having a base portion and a flange portion which is widened relative to the base. The strip is attached to an associated subfloor structure by any suitable means.

An assembly joint is thus defined by an abutment of the first end of a first board and a second end of a second board of the boards in the system. The assembly joint includes the upper end portions of the boards received over the flange portion of the mounting strip in a generally abutting relationship and the lower end portions of the boards received underneath the flange portion generally abutting the base portion.

In the preferred form, the composite structure includes a plurality of pre-assembled integral sections wherein each section includes a plurality of the flooring boards made integral with each other in a side-by-side arrangement. The sections may be slidably received on the channel strips with a joint formed according to the invention between the abutting ends of the different sections with the abutting sides of adjacent sections being in a free abutment.

Accordingly, an important object of the present invention is to provide a composite structure for a floor or wall system having an improved joint which more readily accommodates expansion of the individual boards and more readily resists longitudinal buckling of the boards.

Another important object of the present invention is to provide a composite structure for a floor system and the like wherein each individual board requires a minimum of cutting and finishing to provide a simple and economical floor system.

Still another important object of the present invention is to provide a composite stucture for a floor system and the like which includes a plurality of preformed sections with each section including a plurality of boards made integral in a side-by-side arrangement.

Yet another important object of the present invention is to provide a composite structure and assembly joint for a floor system and the like wherein the individual boards comprising the system do not require elaborate tongue and grooving but are made integral by means of a unique assembly joint for joining the ends thereof.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
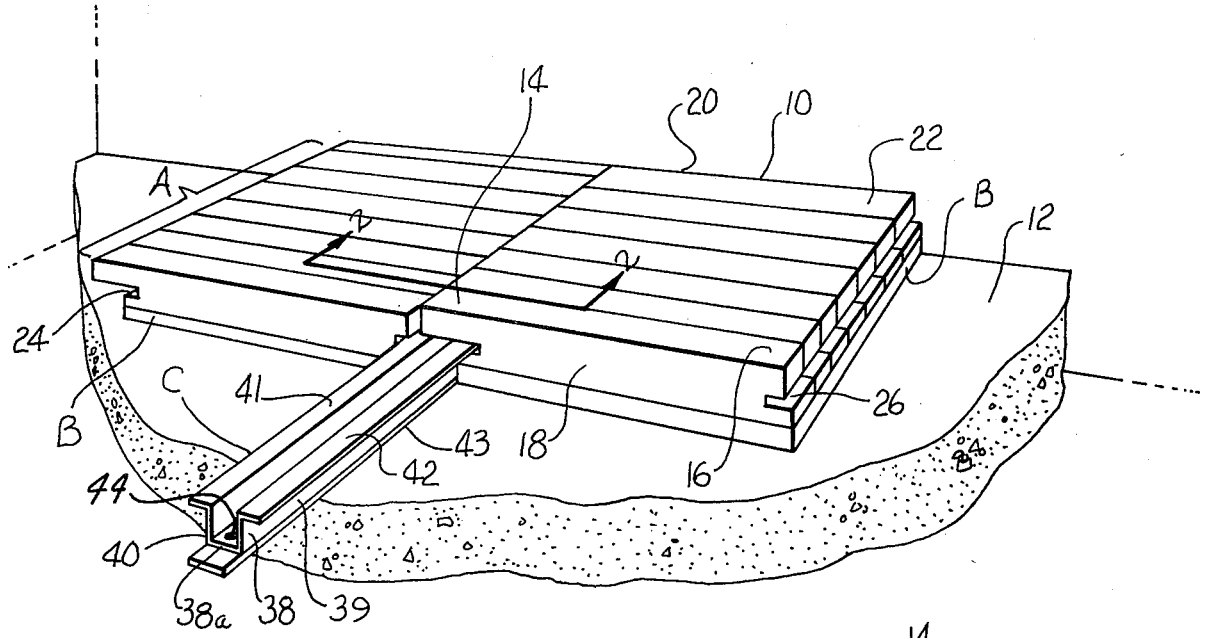
FIG. 1 is a perspective view of the elements of a composite structure and assembly joint for constructing a floor system according to the invention.
Figure 3:
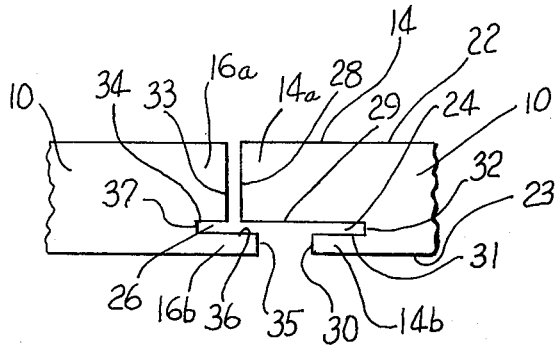
FIG. 3 is an elevational view illustrating the construction of the opposing ends of flooring boards according to the invention.

The invention is directed to a composite structure assembly joint for a flooring system of the type having a planar top wearing surface provided by a plurality of wood boards arranged in a side-by-side and end-to-end abutting configuration. Such flooring systems are popularly utilized in gym floors and in industrial application such as mill floors and many other types of industrial plants. The composite structure may also be utilized in constructing wall surfaces such as walls for handball and squash courts.

Referring now to the drawings, a section of a flooring system is illustrated comprising a plurality of wood boards 10 arranged in a side-by-side and end-to-end abutting configuration. The flooring system is normally supported on a subfloor structure such as a concrete slab 12. The layered composition of a conventional flooring system normally includes the subfloor structure 12, a resilient cushion board 14 with a vapor barrier provided by a polyethylene sheeting material interposed between the cushion board 14 and subfloor 12. The cushion board is normally a resilient board made from a sugar cane byproduct and the polyethylene sheeting is normally a six mil industrial polyethylene sheeting material.

As illustrated, according to the invention, each flooring board 10 includes a first end 14 and a second end 16 remote from the first end. A pair of spaced sides 18 and 20 extend between the first and second ends. It is noted that the sides are flat and require no tongue and grooving. In fact, the sides are totally devoid of any interconnection with sides of adjacent boards when arranged in a composite structure according to the invention. A planar top wear surface 22 is spaced from a planar bottom surface 23 with the top and bottom surfaces integral with and bridging the sides and ends.

In a preferred form of the invention, the composite floor structure includes a plurality of sections A each of which includes a plurality of the flooring boards 10 arranged in side-by-side abutment made integral by affixing the individual boards to a bottom layer of a cushion board B. The bottom layer B includes a one-piece section of the cushion board material 14 made integral by means of gluing the individual boards to the cushion board B. Any suitable adhesive may be utilized such as Ashfelt adhesive. The cushion board section B coextends with the bottom surface of the boards of section A.

When the flooring system is being utilized in a mill or other industrial application, it is sometimes desirable to omit the use of the cushion board 14 and utilize a thin layer of felt material in its place. In this case, the section A of boards may be made integral by gluing the boards to a layer of felt. Thus, by having the boards pre-assembled in sections, the boards are assembled by section rather than individually. Only the ends are required to be joined by an end assembly joint according to the invention to complete the floor system. Not only does this result in a savings in time and labor in installing the floor but the floor is maintained more evenly by the integral side assembly of the individual boards in each section as opposed to utilizing individual and loose boards.

The first end 14 of each board 10 includes an upper end portion **14*a* and a lower portion 14*b* terminating longitudinally short of the upper end portion 14*a*. A groove 24 is defined between the upper and lower end portions being open at the first end. The second end 16 of each board 10 includes an upper end portion 16*a* and a lower end portion 16*b* extending longitudinally past the upper end portion 16*a*. A groove 26** is defined between the upper and lower end portions being open at the second end.

The upper end portion **14*a* is defined by a surface 28 integral with the top surface 22 extending downwardly therefrom and a second surface 29 integral with the surface 28 extending inwardly longitudinally of the board. The lower end portion 14*b* is defined by a surface 30 integral with the bottom surface 23 extending upwardly therefrom and a surface 31 integral with the surface 30 extending inwardly longitudinally of the board. A bridging surface 32 joins the surface 29 and surface 31 to define the groove 24**.

The upper end portion **16*a* is defined by a surface 33 extending downwardly from the top surface 22 and a surface 34 integral with the surface 33 extending inwardly longitudinally of the board. The lower end portion 16*b* is defined by a surface 35 integral with the bottom surface 23 and extending upwardly therefrom and a surface 36 integral with the surface 35 extending inwardly longitudinally of the board. A bridging surface 37 joins the surface 34 and the surface 36 to define the groove 26**.

An elongated mounting strip is provided in the form of a channel strip C which includes a base portion 38 and a generally horizontal flange portion which is widened relative to the base portion 38. The base portion includes a base **38*a* and a pair of spaced sides 39 and 40 extending upwardly from the base 38*a*. The flange portion includes a first outwardly extending flange 41 carried by the side 40 and a second outwardly extending flange 42 integrally carried by the side 39. An elongated resilient strip 43 is carried beneath the channel strip C and coextends with the bottom surface of base 38*a*. Any suitable means may be provided for attaching the channel strip C to the associated subfloor 12 such as by spaced openings 44 through which a fastener 45 may be driven into the subfloor 12**.

Figure 2:
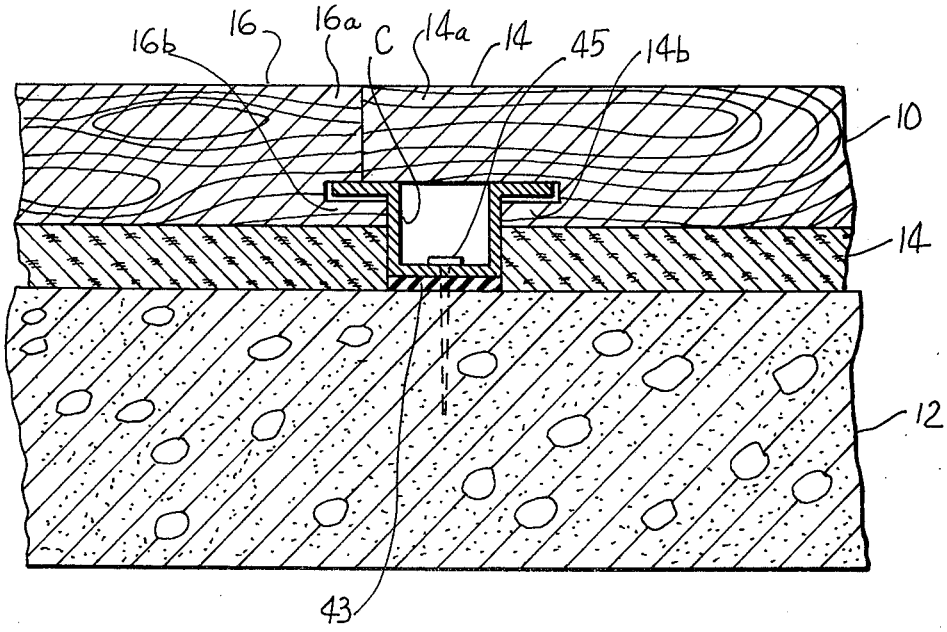
FIG. 2 is an enlarged view taken along section line 2—2 of FIG. 1.

Referring now to FIG. 2, an assembly joint is illustrated defined by the abutment of the first end 14 of one board with the second end 16 of another board in the flooring system. The illustrated assembly joint includes a length of the channel strip C with the flange means or portion of the channel strip being received in the grooves 24 and 26 of the first and second ends, respectively. The upper end portion **16*a* of the second end extends over a portion of the flange 41 and the upper end portion 14*a* of the first end 14 extends over the remaining portion of the flange 41 generally abutting the upper end portion 16*a*. It will be noted that the upper end portion 14*a* is supported on the second flange 42 as well as the remaining portion of the first flange 41. Thus, the joint between the surfaces 33 and 28 will be supported over a flange portion and will not appear over the open top of the channel strip C. With the first and second ends of the respective boards installed over the channel strip in this manner, the lower ends 14*b* and 16*b* of the respective boards will generally abut the base portion 38 of the channel strip. It is to be understood that the boards may have some minute amount of play between the abutting or adjacent surfaces, but that the ends thereof generally abut each other as well as the base portion of the channel strip so that a tight construction may be had. It will also be noted that the cushion board abuts the base portion 38 of the channel strip with shock absorbing resilient strip 43** positioned there beneath.

Once the mounting strips C have been fastened in place, the sections A or individual boards 10, in whichever form the invention is practiced, are slidably received over the strips C and interlocked therewith. It will be noted that the complimentary ends of the boards are not only uniquely joined but are also secured to the subfloor structure 12. Conventional molding may be used around the edges of the floor against the wall to finish the floor as desired.

Thus, it can be seen that an advantageous construction can be had for a composite floor or wall structure according to the invention. The need or expensive tongue and grooving of the sides of the aboard is eliminated according to the invention while increased resistence to buckling and increased accommodation to expansion is provided. The even appearance and integrity of the composite structure according to the invention is enhanced by the use of pre-assembled sections of side-by-side boards whereby only the ends thereof need be joined with the assembly joint of the invention. The assembly joint provided by the channel strip C is semi-resilient so that flexibility of the joint between abutting ends 14*a* and 16*a* of the board is achieved even when flexing is not accommodated by the cushion board 14. Savings in time and labor is afforded by the pre-assembled sections of the floor boards wherein placement of the boards and cushion therebeneath can be had simultaneously.

For purposes of example and not limitation thereto, the following dimensions are given to illustrate the invention.

length of board 10: 16 inches
width of board: 3 inches
thickness of board: 1 inch
thickness of upper end portions: ½ inch
thickness of grooves 24 and 26: ⅛ inch
number of boards 10 in section A: 7

The channel-lock construction of the end joint assembly and uniform short board configuration effectively compensate for any uneveness of the subfloor and reduce the occurrence of "dead spots" when used as a gym floor. The random board length configuration and anchoring procedures of conventional flooring systems often produce these "dead spots" over depressions in the uneven subfloor surface. This causes a ball to bounce flat in the area of the spot.

While a preferred embodiment of the invention has been described using specific terms, such description is for illustrative purposes only, and it is to be understood that changes and variations may be made without departing from the spirit or scope of the following claims.

What is claimed is:

1. In a structural system of the type for constructing floor structures having a planar top wear surface provided by a plurality of wood boards substantially identical in length arranged generally in a side-by-side and end-to-end abutting configuration, apparatus for assembling said boards comprising:

(a) each said board being substantially elongated to define a first end, a second end remote from said first end, a pair of spaced elongated longitudinal sides extending between the first and second ends, a planar bottom surface integral with and bridging said sides, and said top wear surface spaced from said bottom surface integral with and bridging said sides;

(b) said first end of each board including:
(i) an upper end portion,
(ii) a lower end portion spaced below and terminating longitudinally short of said upper end portion; and
(iii) a groove defined between said upper and lower end portions being open at said first end;

(c) said second end of each board including:
(i) an upper end portion,
(ii) a lower end portion spaced below said upper end portion extending longitudinally past said upper end portion, and
(iii) a groove defined between said upper and lower end portions being open at said second end, (d) an elongated channel strip for being fastened to an associated subfloor structure including first and second generally horizontally outwardly extending flange means;

(e) a n end assembly joint defined by the abutment of the first end of one board with the second end of another board in said system;

(f) said assembly joint including lengths of said channel strip extending generally across the entire width of said structure surface being formed contiguously across each said assembly joint in said system joining said boards in a side-by-side arrangement, said flange means of said channel strip being received in said groove of said first end and in said groove of said second end, said upper end portion of said second end extending over a portion of said first flange means and said upper end portion of said first end extending over said second flange means and the remaining portion of said first flange means generally abutting said upper end portion of said second end; and (g) said plurality of boards being joined in side-by-side arrangement by said assembly joint connecting said ends with said planar longitudinal sides being essentially devoid of interconnection therebetween.

2. The apparatus of claim 1 wherein said channel strip includes a base, spaced sides integral with said base extending upwardly therefrom, said flange means includes a first outwardly extending flange integrally carried on one of said sides and a second outwardly extending flange integrally carried on the other of said sides, and said spaced sides of said channel accommodating fastening means therebetween for fastening said channel strip to said subfloor structure.

3. The apparatus of claim 2 wherein said assembly joint includes said upper end portion of said second end extending over a portion of said first flange and said upper end portion of said first end extending over said second flange and the remaining portion of said first flange.

4. The apparatus of claim 1 wherein said assembly joint includes said lower end portions of each of said boards being received underneath said flange means.

5. The apparatus of claim 1 including an elongated resilient strip extending coextensively with said channel strip secured therebeneath.

6. A composite structure for use in a flooring system of the type having a plurality of elongated boards substantially identical in length arranged generally in side-by-side and end-to-end abutment, said structure comprising:

(a) each said board including first and second spaced ends, a pair of spaced planar sides extending longitudinally between said first and second ends, a top wear surface bridging said sides and ends, and a planar bottom surface spaced from said top wear surface integrally bridging said ends and sides;

(b) said first end of each said board including a lateral groove formed therein defining an upper end portion and a lower end portion with said lower end portion terminating short of said upper end portion;

(c) said second end of each said board including a lateral groove formed therein defining an upper end portion and a lower end portion with said lower end portion extending longitudinally past said upper end portion;

(d) an elongated mounting strip extending generally across the entire length of one of the dimensions of said composite structure having a base portion for being secured to an associated subfloor structure and a flange portion widened relative to said base;

(e) an assembly joint defined by the abutment of a first end of a first board and a second end of a second board;

(f) said assembly joint including said upper end portions of said boards received over said flange portion in a generally abutting relationship, said lower end portions of said boards received underneath said flange portion generally abutting said base portion; and (g) said plurality of boards being joined in said side-by-side arrangement by said assembly joint connecting said ends with said planar longitudinal sides being essentially devoid of interconnection therebetween.

7. The structure of claim 6 including a plurality of integral sections, each section including a plurality of said boards made integral with one another in a side-by-side arrangement.

8. The structure of claim 7 wherein said boards of said section are made integral by affixation to a one piece section of material integrally carried coextensively with the bottom surface of said section.

* * * * *